US010060634B2

(12) United States Patent
Jiang et al.

(10) Patent No.: US 10,060,634 B2
(45) Date of Patent: Aug. 28, 2018

(54) RANGE HOOD AND VOLUTE CASING THEREOF

(71) Applicant: WUHU MIDEA KITCHEN APPLIANCES MANUFACTURING CO., LTD., Wuhu (CN)

(72) Inventors: Jiwu Jiang, Wuhu (CN); Zhenghua Wang, Wuhu (CN); Yuxia Su, Wuhu (CN); Junsheng Ji, Wuhu (CN); Benfeng Li, Wuhu (CN); Yali Bai, Wuhu (CN)

(73) Assignee: WUHU MIDEA KITCHEN APPLIANCES MANUFACTURING CO., LTD., Wuhu (CN)

( * ) Notice: Subject to any disclaimer, the term of this patent is extended or adjusted under 35 U.S.C. 154(b) by 156 days.

(21) Appl. No.: 15/123,709

(22) PCT Filed: Nov. 17, 2014

(86) PCT No.: PCT/CN2014/091295

§ 371 (c)(1),
(2) Date: Sep. 6, 2016

(87) PCT Pub. No.: WO2016/037414

PCT Pub. Date: Mar. 17, 2016

(65) Prior Publication Data

US 2017/0016629 A1 Jan. 19, 2017

(30) Foreign Application Priority Data

Sep. 12, 2014 (CN) ..... 2014 1 0466253
Sep. 12, 2014 (CN) ..... 2014 2 0526495 U

(51) Int. Cl.
*F24C 15/20* (2006.01)
*F04D 29/42* (2006.01)
(Continued)

(52) U.S. Cl.
CPC ..... *F24C 15/2042* (2013.01); *F04D 17/04* (2013.01); *F04D 25/14* (2013.01);
(Continued)

(58) Field of Classification Search
CPC ..... F24C 15/2042; F24C 15/20; F24F 7/00; F24F 2007/001; F04D 25/10; F04D 29/4246
(Continued)

(56) References Cited

U.S. PATENT DOCUMENTS 2,297,049 A 9/1942 Cotton et al.
2,839,987 A * 6/1958 Pryne ..... F24C 15/20 126/299 D
(Continued)

FOREIGN PATENT DOCUMENTS

CN 2416417 Y 1/2001
CN 2789658 6/2006
(Continued)

OTHER PUBLICATIONS

International Searching Authority, International Search Report for PCT/CN2014/091295 dated Jun. 17, 2015.
(Continued)

*Primary Examiner* — Gregory Huson
*Assistant Examiner* — Daniel E Namay
(74) *Attorney, Agent, or Firm* — Hodgson Russ LLP

(57) ABSTRACT

A range hood includes a housing defining a first outer air vent and a second outer air vent; a volute casing disposed within the housing, including a volute casing body having a bottom plate, a top plate and a side encasing plate disposed between the bottom plate and the top plate, the volute casing body defining an outer air outlet communicated with the first outer air vent and the second outer air vent, an opening direction of the outer air outlet being orthogonal to that of
(Continued)

the second outer air vent; a fan wheel disposed within the volute casing body; and an outer switching cover plate movable between a first position, in which the first outer air vent is opened and the second outer air vent is closed, and a second position, in which the first outer air vent is closed and the second outer air vent is opened.

18 Claims, 14 Drawing Sheets

(51) Int. Cl.

| | |
|---|---|
| ***F04D 17/04*** | (2006.01) |
| ***F04D 29/00*** | (2006.01) |
| ***F24F 7/00*** | (2006.01) |
| ***F04D 25/14*** | (2006.01) |
| ***F04D 29/46*** | (2006.01) |
| *F04D 25/10* | (2006.01) |
| *F24F 7/007* | (2006.01) |

(52) U.S. Cl.
CPC ..... *F04D 29/00* (2013.01); *F04D 29/4246* (2013.01); *F04D 29/46* (2013.01); *F24C 15/20* (2013.01); *F24F 7/00* (2013.01)

(58) Field of Classification Search
USPC ..... 126/299 D; 454/49, 67, 256, 66, 253, 454/204, 206, 127
See application file for complete search history.

(56) References Cited

U.S. PATENT DOCUMENTS

| | | | | | |
|---|---|---|---|---|---|
| 2,874,628 | A * | 2/1959 | Pryne | F24C 15/20 | 126/299 D |
| 3,098,423 | A * | 7/1963 | Giannini | F24C 15/2071 | 126/299 D |
| 3,145,643 | A * | 8/1964 | Strouth | F24C 15/20 | 126/299 D |
| 3,194,146 | A | 7/1965 | Jenson | | |
| 3,359,885 | A * | 12/1967 | Fachling | F24C 15/2092 | 126/299 D |
| 3,362,319 | A * | 1/1968 | Wallace | F24C 15/20 | 126/299 D |
| 3,589,266 | A * | 6/1971 | Hike | F24C 15/20 | 126/299 D |
| 4,089,328 | A | 5/1978 | Bergmark et al. | | |
| 5,092,136 | A | 3/1992 | Kang | | |
| 5,738,083 | A | 4/1998 | Pettinari | | |
| 6,073,305 | A | 6/2000 | Hesskamp | | |
| 9,057,527 | B2 * | 6/2015 | Oagley | F24C 15/20 | |
| 2011/0036340 | A1 * | 2/2011 | Chu | F24C 15/20 | 126/299 D |

FOREIGN PATENT DOCUMENTS

| | | | | | |
|---|---|---|---|---|---|
| CN | 201476129 | U | 5/2010 | | |
| CN | 204313343 | U | 5/2015 | | |
| EP | 0940633 | A2 * | 9/1999 | F24C 15/20 | |
| EP | 2487424 | A1 | 8/2012 | | |
| JP | 58187599 | A * | 11/1983 | F04D 17/04 | |

OTHER PUBLICATIONS

EPO, Office action for EP application 14885061 dated Sep. 22, 2017.

* cited by examiner

RANGE HOOD AND VOLUTE CASING THEREOF

CROSS-REFERENCE TO RELATED APPLICATIONS

The present application is a national phase entry under 35 USC § 371 of International Application PCT/CN2014/091295, filed Nov. 17, 2014, which claims the benefit of and priority to Chinese Patent Application No. 201410466253.8 filed Sep. 12, 2014 and No. 201420526495.7 filed Sep. 12, 2014, the entire disclosures of which are incorporated herein by reference.

FIELD

The present disclosure relates to a range hood and a volute casing for the range hood.

BACKGROUND

In the related art, the range hood is generally formed with a plurality of air vents, whose opening directions are orthogonal to each other, in order to make it easier to connect the range hood with air vent flues in different positions to discharge air outdoors. The range hood with a plurality of air vents has defects of a large loss of air volume and air pressure, a low efficiency of fan wheel and too much noise.

SUMMARY

The present disclosure is based on the finding of the following facts and issues by the inventors:

For example, in the related art, the range hood with a plurality of air vents is generally formed with a rear air vent and an upper air vent, and the opening direction of the rear air vent is orthogonal to that of the upper air vent. When air is discharged through the upper air vent, the air discharged from an air outlet of a volute casing of the range hood is substantially orthogonal to the upper air vent. When the air stream is discharged from the upper air vent, the air stream needs to be turned though 90 degrees, which results in a larger loss of the air volume and air pressure, reduces the efficiency of the fan wheel of the range hood and generates more noise in a vortex region.

The present disclosure seeks to solve at least one of the problems existing in the related art to at least some extent. Therefore, the present disclosure provides a range hood having advantages of less loss of air volume and air pressure, a high efficiency of fan wheel and less noise.

The present disclosure also relates to a volute casing of the range hood.

A range hood according to embodiments of a first aspect of the present disclosure includes: a housing defining a first outer air vent and a second outer air vent; a volute casing disposed within the housing, and including a volute casing body having a bottom plate, a top plate and a side encasing plate disposed between the bottom plate and the top plate, the volute casing body defining an outer air outlet communicated with the first outer air vent and the second outer air vent, and an opening direction of the outer air outlet being orthogonal to that of the second outer air vent; a fan wheel disposed within the volute casing body; and an outer switching cover plate disposed on one of the volute casing and the housing and movable between a first position, in which the first outer air vent is opened by the outer switching cover plate and the second outer air vent is closed by the outer switching cover plate, and a second position, in which the first outer air vent is closed by the outer switching cover plate and the second outer air vent is opened by the outer switching cover plate, an angle $\alpha$ between the outer switching cover plate in the second position and the opening direction of the second outer air vent being greater than 0 degree and less than 90 degrees.

The range hood according to embodiments of the present disclosure has advantages of less loss of air volume and air pressure, a high efficiency of fan wheel and less aerodynamic noise.

In some embodiments, an opening direction of the first outer air vent is orthogonal to the opening direction of the second outer air vent.

In some embodiments, the angle $\alpha$ is equal to or greater than 30 degrees and equal to or less than 60 degrees.

In some embodiments, the outer switching cover plate is disposed on the side encasing plate and pivotable between the first position and the second position.

In some embodiments, a snapping groove is formed in the side encasing plate, and the outer switching cover plate includes a plate body and a pivot which is disposed on the plate body and rotatably fitted within the snapping groove.

In some embodiments, the first outer air vent is formed in a rear wall plate of the housing, and the second outer air vent is formed in a top wall plate of the housing.

In some embodiments, the outer switching cover plate is a flat plate or a curved plate.

In some embodiments, the housing defines a cover plate position-restricting hole, the outer switching cover plate includes a plate body and a catching jaw which is disposed on the plate body and engaged within the cover plate position-restricting hole in the first position.

In some embodiments, the range hood further includes an outer air vent seal-plate, in which the housing defines an inner air vent, the volute casing body defines an inner air outlet communicated with the inner air vent, the volute casing further includes an inner switching cover plate movable between an opened position, in which the inner air outlet is opened by the inner switching cover plate, and a closed position, in which the inner air outlet is closed by the inner switching cover plate, in which the outer air vent seal-plate seals an opened one of the first outer air vent and the second outer air vent in the opened position.

In some embodiments, a shape of the inner switching cover plate is configured such that a complete volute casing curved surface is formed by the side encasing plate and a part of the inner switching cover plate in the closed position corresponding to the inner air outlet.

In some embodiments, the inner air outlet is formed in a helical curved surface of the volute casing curved surface.

In some embodiments, the side encasing plate includes a first side encasing plate and a second side encasing plate, in which a first end of the first side encasing plate is spaced apart from a first end of the second side encasing plate such that the inner air outlet is defined by the first end of the first side encasing plate, the first end of the second side encasing plate, the top plate and the bottom plate, in which a second end of the first side encasing plate is spaced apart from a second end of the second side encasing plate such that the outer air outlet is defined by the second end of the first side encasing plate, the second end of the second side encasing plate, the top plate and the bottom plate.

In some embodiments, a first position-restricting groove is formed in the first end of the first side encasing plate, a second position-restricting groove is formed in the first end of the second side encasing plate, the first end of the inner switching cover plate is engaged within the first position-restricting groove in the closed position, and the second end of the inner switching cover plate is engaged within the second position-restricting groove in the opened position.

In some embodiments, the inner switching cover plate clings to the side encasing plate closely during moving between the opened position and the closed position.

In some embodiments, the bottom plate defines a chute penetrating therethrough in a thickness direction thereof, the inner switching cover plate is slidably fitted within the chute, the inner switching cover plate is provided with a snapping projection on the bottom plate and an operation portion which is below the bottom plate for moving the inner switching cover plate along the chute.

In some embodiments, the bottom plate is provided with a first position-restricting column and a second position-restricting column thereon, the snapping projection is abutted against the first position-restricting column in the closed position, and the snapping projection is abutted against the second position-restricting column in the opened position.

In some embodiments, the bottom plate is provided with a first position-restricting boss and a second position-restricting boss thereon, the operation portion defines a first position-restricting hole and a second position-restricting hole therein, the first position-restricting boss is engaged within the first position-restricting hole in the closed position, and the second position-restricting boss is engaged within the second position-restricting hole in the opened position.

A volute casing according to embodiments of a second aspect of the present disclosure includes: a volute casing body including a bottom plate, a top plate and a side encasing plate disposed between the bottom plate and the top plate, the volute casing body defining a first outer air outlet and a second outer air outlet, and an opening direction of the first outer air outlet being orthogonal to that of the second outer air outlet; and an outer switching cover plate disposed on the volute casing body and movable between a first position, in which the first outer air outlet is opened by the outer switching cover plate and the second outer air outlet is closed by the outer switching cover plate, and a second position, in which the first outer air outlet is closed by the outer switching cover plate and the second outer air outlet is opened by the outer switching cover plate, an angle $\alpha$ between the outer switching cover plate in the second position and the opening direction of the second outer air outlet being greater than 0 degree and less than 90 degrees.

In some embodiments, the angle $\alpha$ is equal to or greater than 30 degrees and equal to or less than 60 degrees.

Figure 1:
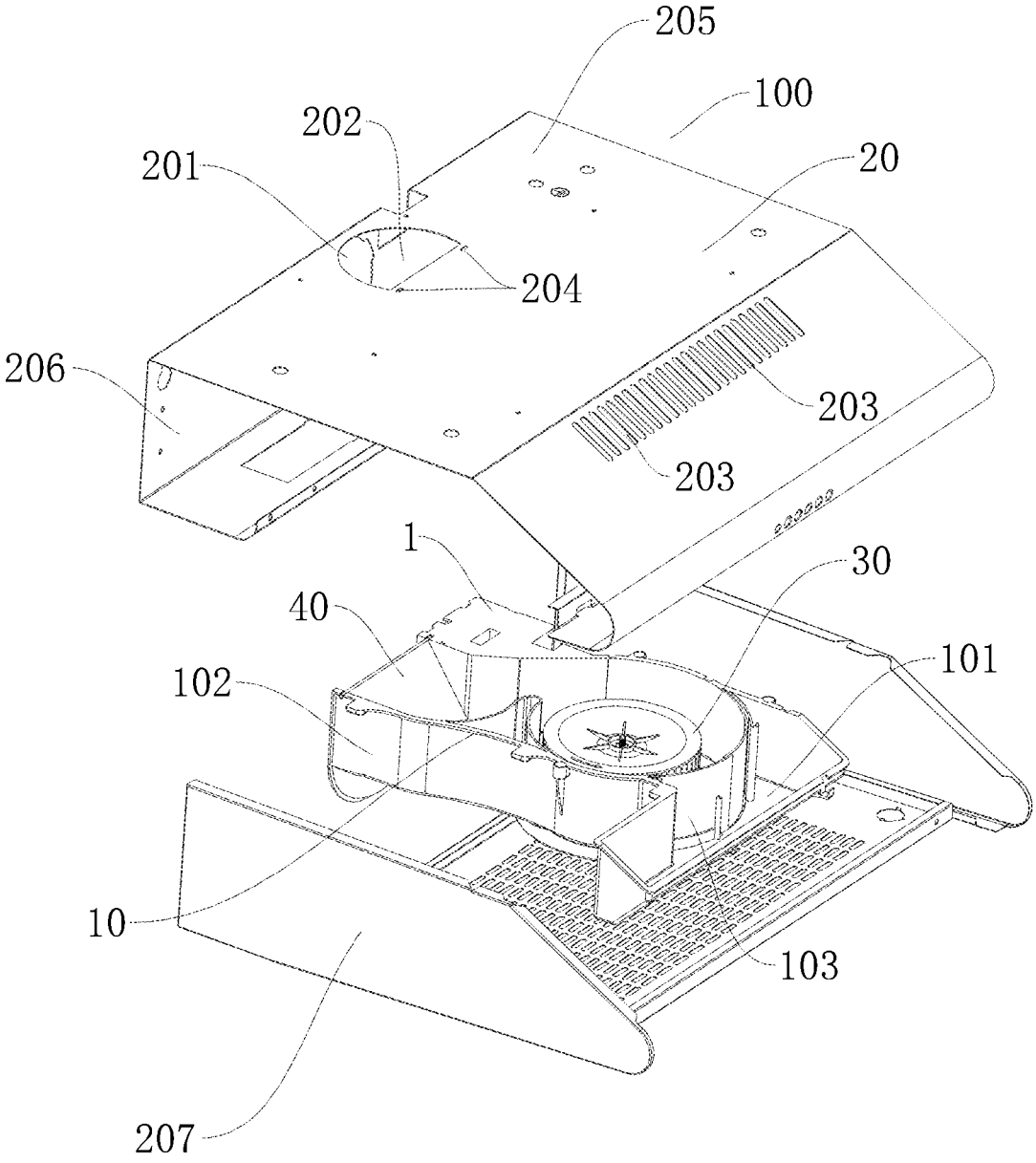
FIG. 1 is an exploded view of a range hood according to an embodiment of the present disclosure, in which the outer switching cover plate is located in a second position.
Figure 2:
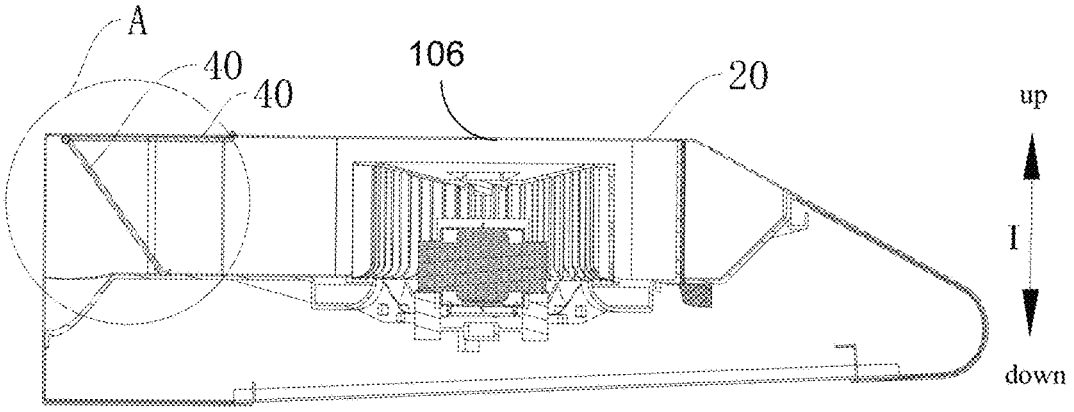
FIG. 2 is a side sectional view of a range hood according to an embodiment of the present disclosure.
Figure 3:
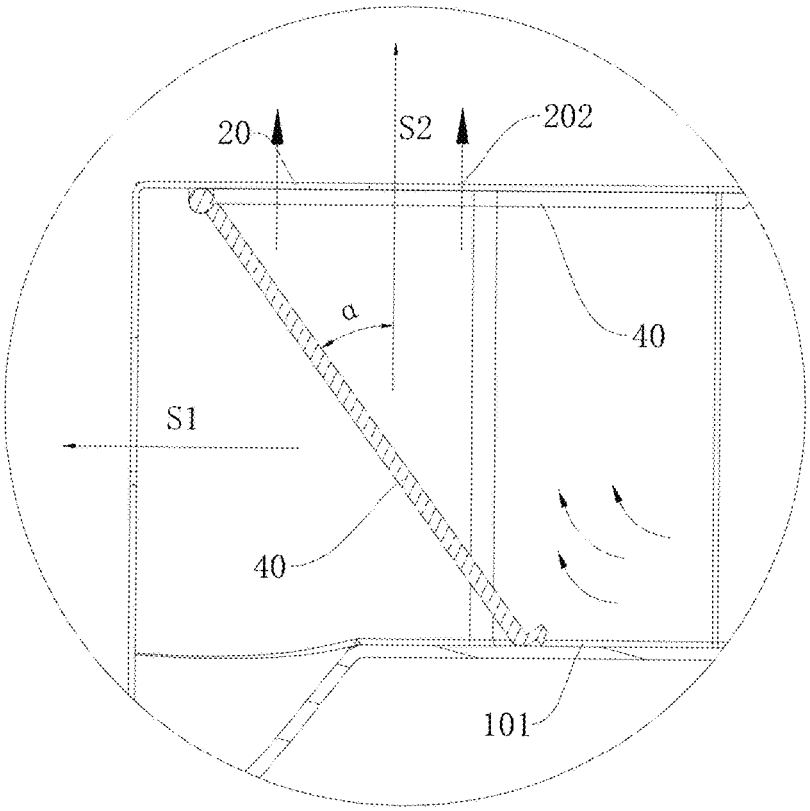
FIG. 3 is an enlarged view of A region of FIG. 2.

REFERENCE NUMERALS range hood 100, volute casing 1 volute casing body 10, outer air outlet 105, inner air outlet 104, top plate 106, bottom plate 101, chute 1011, first position-restricting column 1012, second position-restricting column 1013, first position-restricting boss 1014, second position-restricting boss 1015, side encasing plate 102, first position-restricting groove 1021, second position-restricting groove 1022, first side encasing plate 1023, first end 10231, second end 10232, second side encasing plate 1024, first end 10241, second end 10242, snapping groove 1025, inner switching cover plate 103, body 1031, operation portion 1032, snapping projection 1033, first position-restricting hole 1034, second position-restricting hole 1035, first end 1036, second end 1037, outer switching cover plate 40, plate body 401, pivot 402, catching jaw 403, drainage surface 404, housing 20, first outer air vent 201, second outer air vent 202, inner air vent 203, cover plate position-restricting hole 204, top wall plate 205, rear wall plate 206, side wall plate 207, fan wheel 30, outer air vent seal-plate 41, up-down direction I, front-rear direction J.

DETAILED DESCRIPTION

Embodiments of the present disclosure will be described in detail and examples of the embodiments will be illustrated in the drawings, where same or similar reference numerals are used to indicate same or similar members or members with same or similar functions. The embodiments described herein with reference to drawings are explanatory, which are used to illustrate the present disclosure, but shall not be construed to limit the present disclosure.

The range hood 100 according to embodiments of the present disclosure is described with reference to FIG. 1-25. As shown in FIG. 1-25, the range hood 100 according to embodiments of the present disclosure includes a housing 20, a volute casing 1, a fan wheel 30 and an outer switching cover plate 40.

The housing 20 is formed with a first outer air vent 201 and a second outer air vent 202 therein. The volute casing 1 is disposed within the housing 20, and includes a volute casing body 10. The volute casing body 10 includes a bottom plate 101, a top plate 106 and a side encasing plate 102 disposed between the bottom plate 101 and the top plate 106. In this embodiment, the top plate 106 of the volute casing body 10 is formed by a part of the top wall plate 205 of the housing 20. The volute casing body 10 is formed with an outer air outlet 105 communicated with the first outer air vent 201 and the second outer air vent 202, an opening direction of the outer air outlet 105 is substantially orthogonal to that of second outer air vent 202. Herein, it should be understood broadly, for example, an angle between the opening direction of the outer air outlet 105 and the opening direction of second outer air vent 202 may be in the range of (90±10) degrees. The fan wheel 30 is disposed in the volute casing 1, and may be actuated by an electric motor (not shown).

Figure 4:
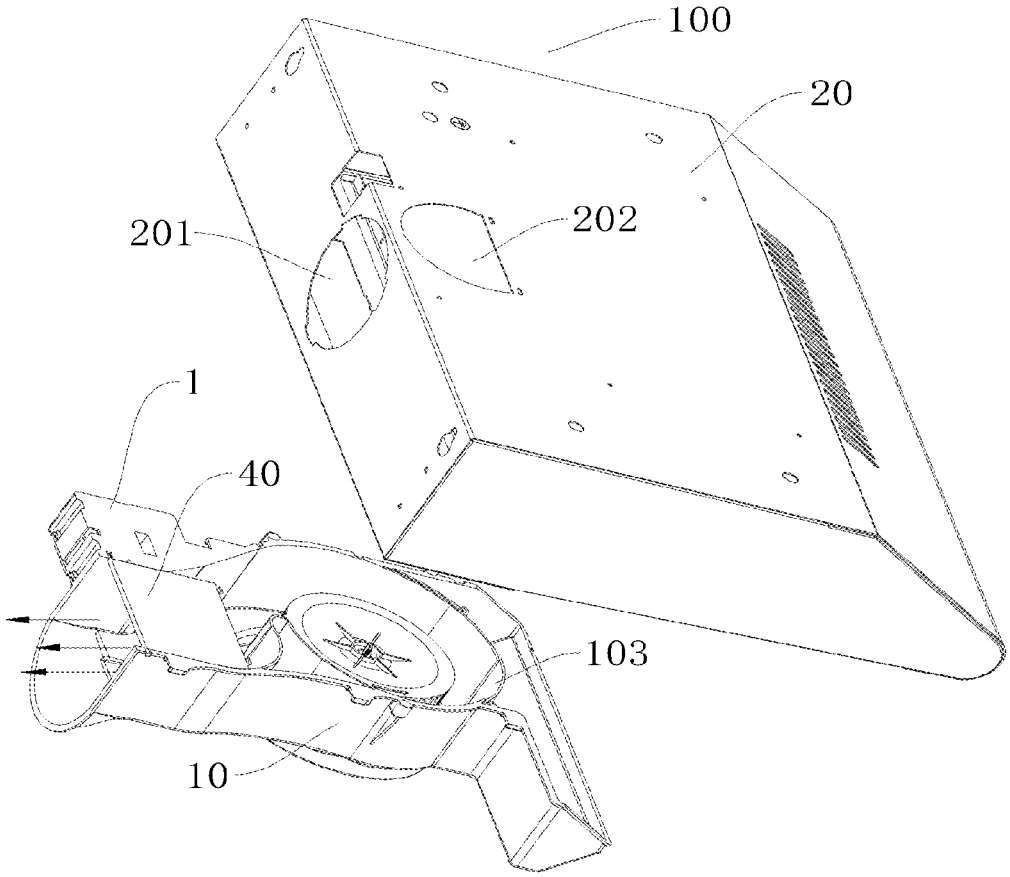
FIG. 4 is an exploded view of a range hood according to an embodiment of the present disclosure, in which the outer switching cover plate is located in a first position.
Figure 5:
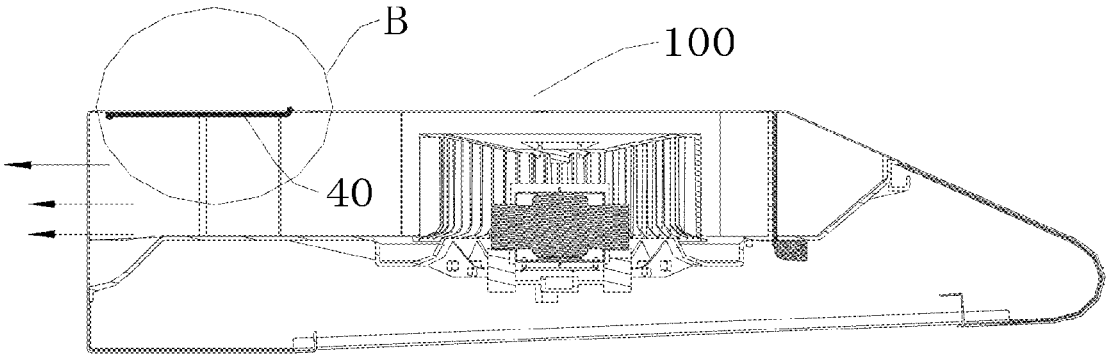
FIG. 5 is a side sectional view of a range hood according to an embodiment of the present disclosure, in which the outer switching cover plate is located in a first position.
Figure 6:
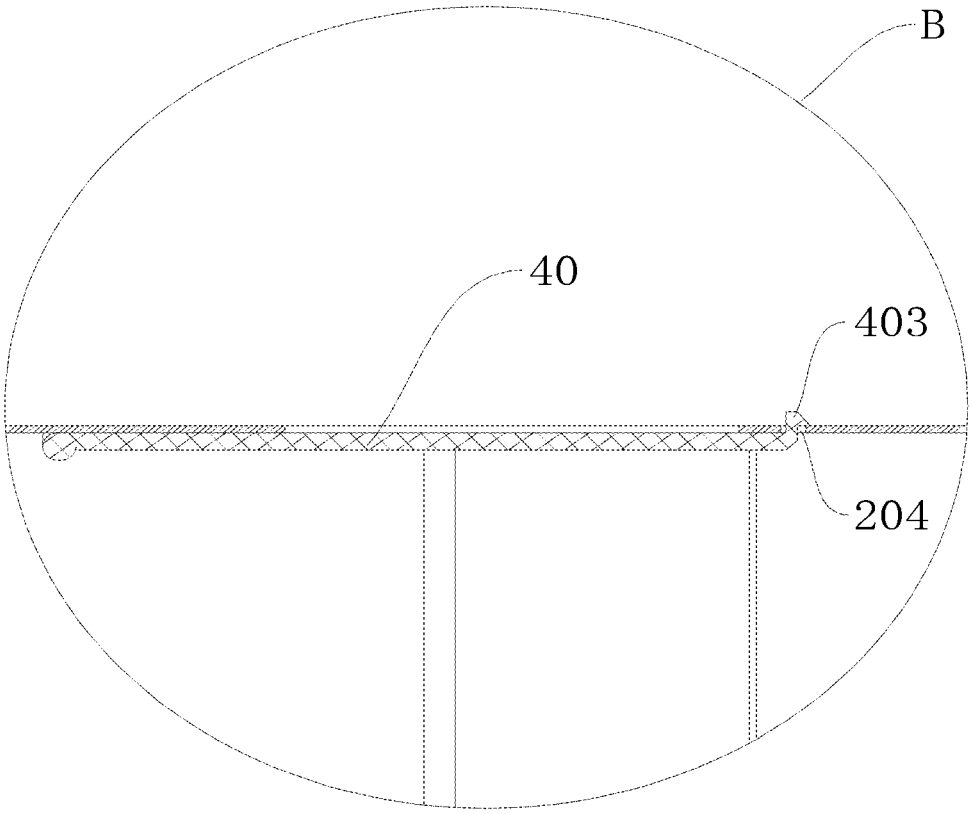
FIG. 6 is an enlarged view of B region of FIG. 5.
Figure 7:
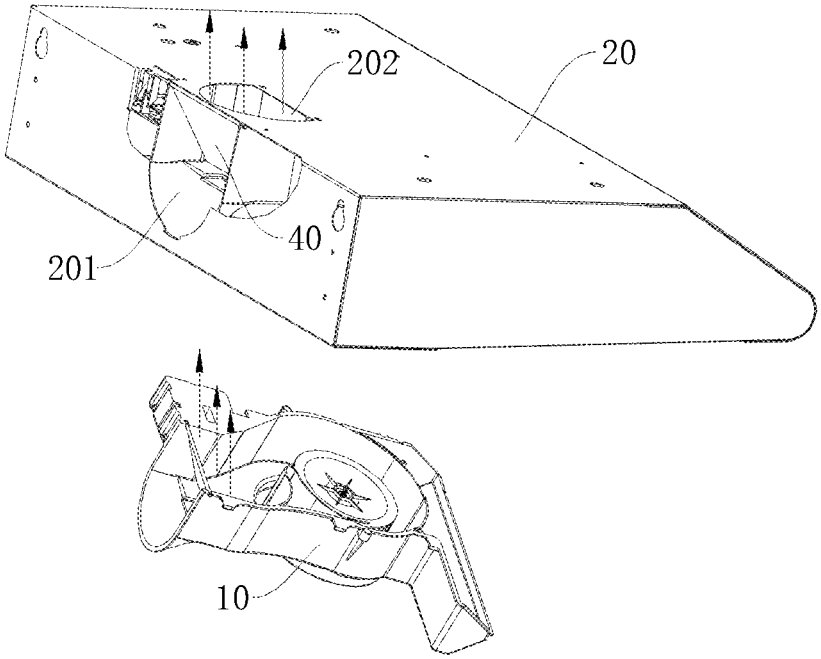
FIG. 7 is an exploded view of a range hood according to an embodiment of the present disclosure, in which the outer switching cover plate is located in a second position.
Figure 8:
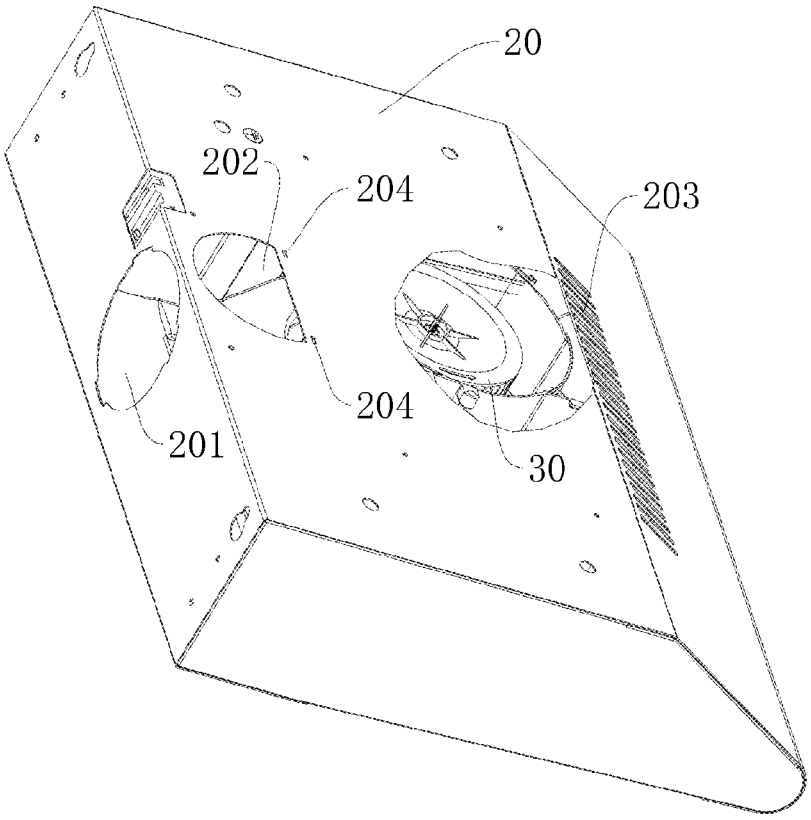
FIG. 8 is a schematic partially sectioned perspective view of a range hood according to an embodiment of the present disclosure.
Figure 9:
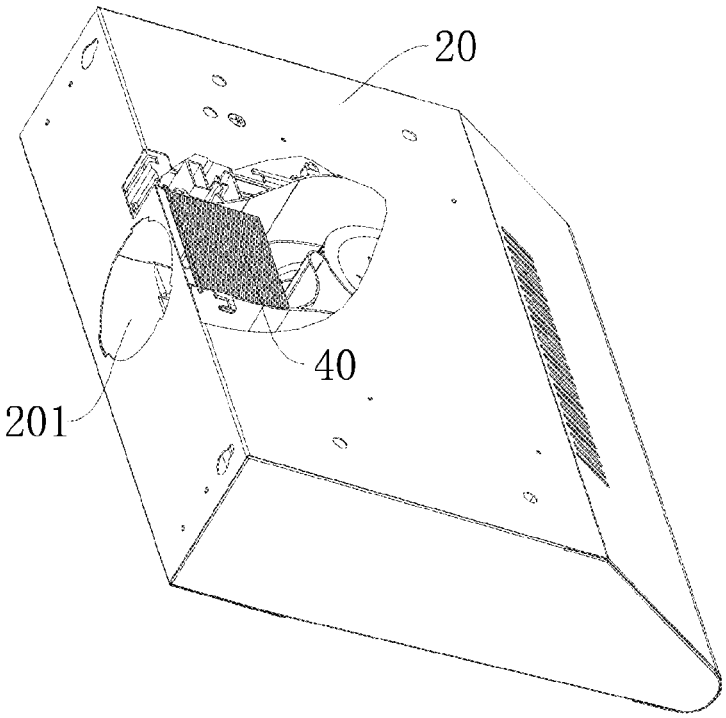
FIG. 9 is a schematic partially sectioned perspective view of a range hood according to an embodiment of the present disclosure.

The outer switching cover plate 40 may be disposed on the volute casing 1 or the housing 20 and movable between a first position (as shown in FIG. 4 and FIG. 5), in which the first outer air vent 201 is opened by the outer switching cover plate 40 and the second outer air vent 202 is closed by the outer switching cover plate 40, and a second position (as shown in FIG. 7 and FIG. 8), in which the first outer air vent 201 is closed by the outer switching cover plate 40 and the second outer air vent 202 is opened by the outer switching cover plate 40. An angle α between the outer switching cover plate 40 in the second position and the opening direction of the second outer air vent 202 is greater than 0 degree and less than 90 degrees.

In other words, the outer switching cover plate 40 may be moved between the first position in which the outer air outlet 105 is communicated with the first outer air vent 201 and separated from the second outer air vent 202 and the second position in which the outer air outlet 105 is separated from the first outer air vent 201 and communicated with the second outer air vent 202. In the second position, the outer switching cover plate 40 is tilted relative to the opening direction S2 of the second outer air vent 202, the angle α between them is greater than 0 degree and less than 90 degrees. More preferably, the angle α is equal to or greater than 30 degrees and equal to or less than 60 degrees.

In some embodiments, an opening direction S1 of the first outer air vent 201 is substantially orthogonal to the opening direction S2 of the second outer air vent 202.

In the following, unless specified otherwise, the first outer air vent 201 is formed in a rear wall plate 206 of the housing 20 and opened backwards, and the second outer air vent 202 is formed in a top wall plate 205 of the housing 20 and opened upwards, which is taken for example. Therefore, the first outer air vent 201 also may be called a rear outer air vent, and the second outer air vent 202 also may be called an upper outer air vent. It should be understood that the first outer air vent 201 may be formed in a side wall plate 207 of the housing 20 and the second outer air vent 202 may be formed in the top wall plate 205 of the housing 20. Alternatively, the first outer air vent 201 may be formed in the side wall plate 207 of the housing 20 and the second outer air vent 202 may be formed in the rear wall plate 206 of the housing 20.

The range hood 100 according to embodiments of the present disclosure may discharge air outdoors through the first outer air vent 201 or the second outer air vent 202. When the outer switching cover plate 40 opens the first outer air vent 201 and closes the second outer air vent 202, the range hood 100 may discharge air backwards through the first outer air vent 201. When the outer switching cover plate 40 opens the second outer air vent 202 and closes the first outer air vent 201, the range hood 100 may discharge air upwards through the second outer air vent 202.

In the second position, the outer switching cover plate 40 is disposed obliquely, i.e. the angle α between the outer switching cover plate 40 and the opening direction S2 (an upward direction in FIG. 3) of the second outer air vent 202 is greater than 0 degree and less than 90 degrees. Thus, the outer switching cover plate 40 may form a drainage slope to guide air to flow upwards and discharge air through the second outer air vent 202. It is possible to prevent air streams from turning through 90 degrees because the outer switching cover plate 40 is parallel to the second outer air vent 202 (i.e. perpendicular to the opening direction S1 of the first outer air vent 201 and an air stream discharged from the outer air outlet 105) in the related art, which may greatly reduce the flow loss of the air stream, improve the efficiency of the fan wheel, and reduce a vortex region in order to reduce aerodynamic noise. That is, the outer switching cover plate 40 in the second position is further used as a drainage plate.

With the range hood 100 according to embodiments of the present disclosure, by disposing the outer switching cover plate 40 in the second position obliquely relative to the second outer air vent 202, the outer switching cover plate 40 may form a drainage slope to guide the air to flow upwards to prevent air streams from turning through 90 degrees. Thus, it is possible to reduce the flow loss of the stream, improve the efficiency of the fan wheel, and reduce the vortex region in order to reduce aerodynamic noise.

Therefore, the range hood 100 according to embodiments of the present disclosure has advantages of less loss of air volume and air pressure, a high efficiency of the fan wheel and less aerodynamic noise.

The range hood 100 according to some specific embodiments of the present disclosure is described below.

As shown in FIGS. 1-12, in some specific embodiments, the range hood 100 includes a housing 20, a volute casing 1, a fan wheel 30 and an outer switching cover plate 40.

The volute casing 1 includes a volute casing body 10, and the volute casing body 10 includes a bottom plate 101, a top plate 106 and a side encasing plate 102 disposed between the bottom plate 101 and the top plate 106. The outer switching cover plate 40 is disposed on the side encasing plate 102 and pivotable between the first position and the second position.

The top plate 106 of the volute casing body 10 may be formed by a part of the top wall plate 205 of the housing 20.

Figure 10:
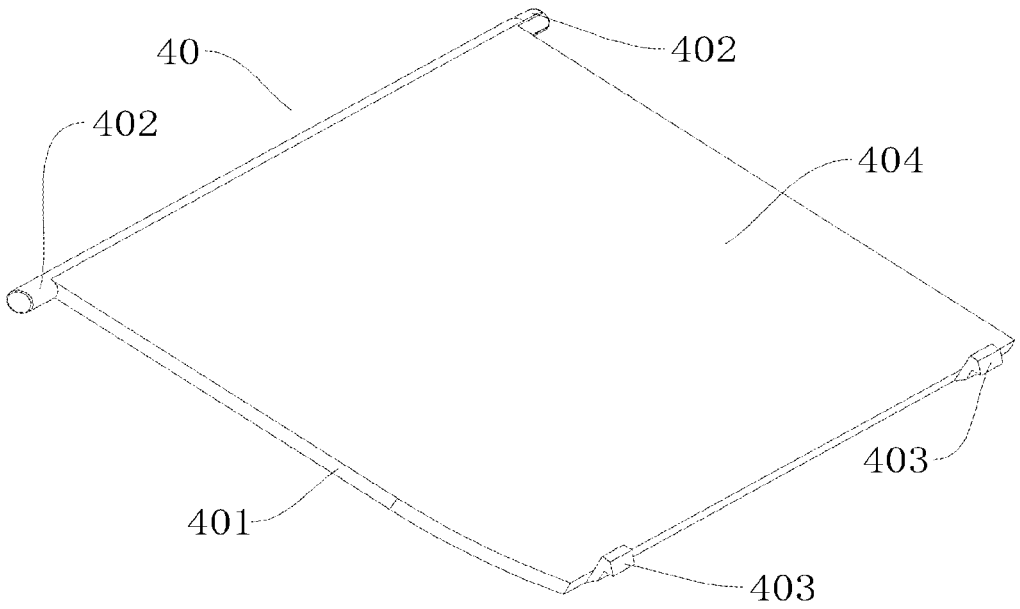
FIG. 10 is a schematic view of an outer switching cover plate of a range hood according to an embodiment of the present disclosure.
Figure 11:
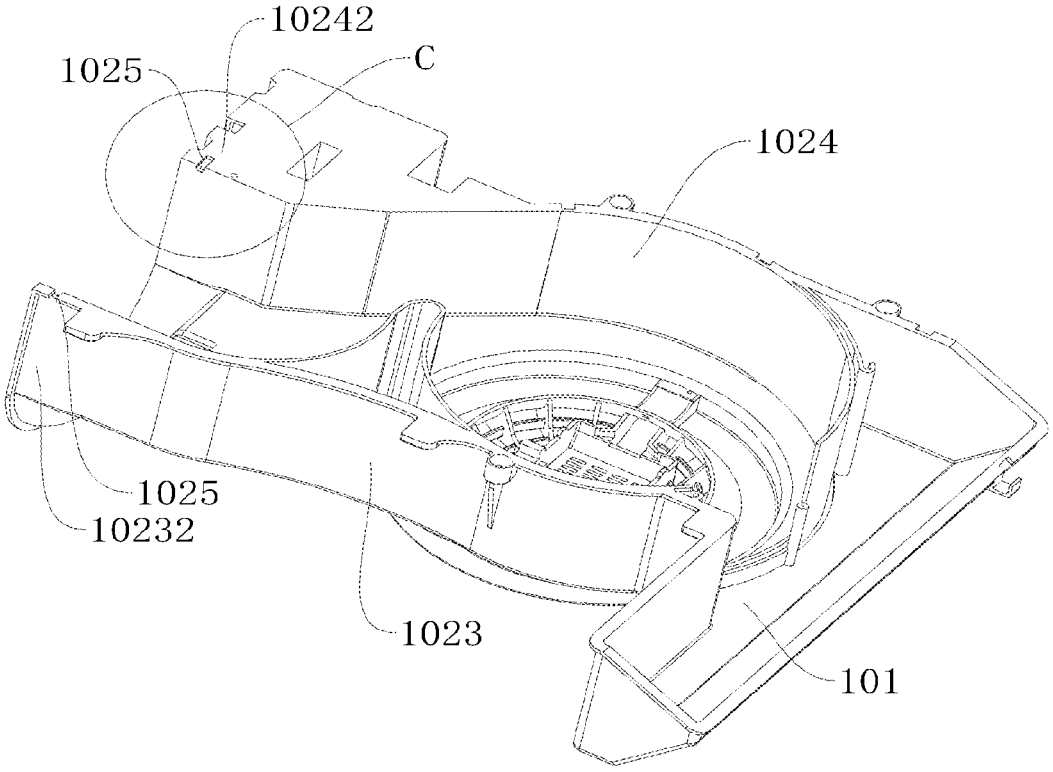
FIG. 11 is a schematic perspective view of a volute casing of a range hood according to an embodiment of the present disclosure.
Figure 12:
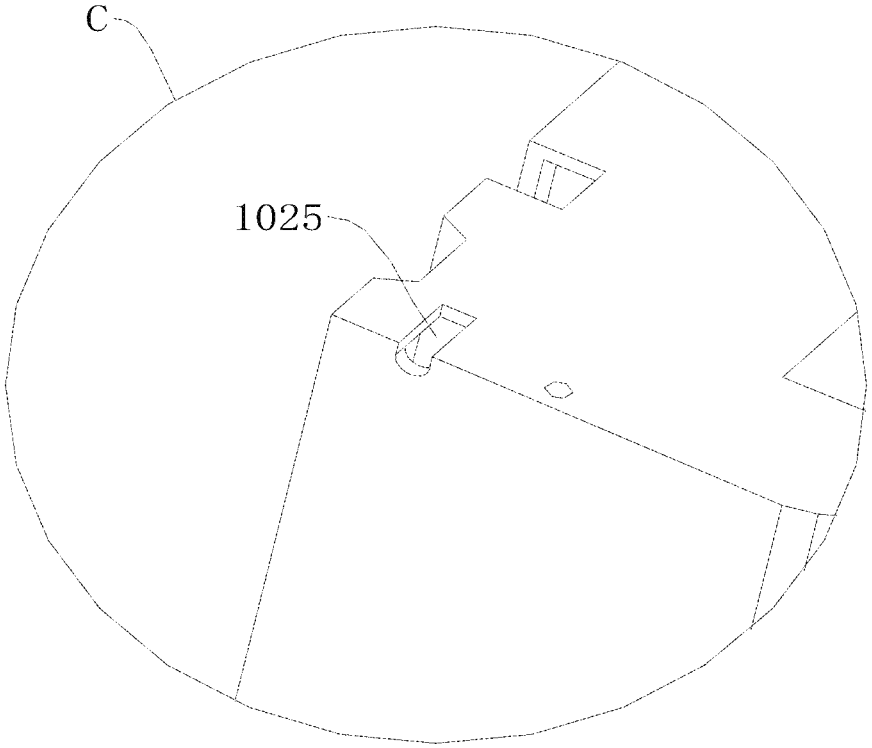
FIG. 12 is an enlarged view of C region of FIG. 11.

As shown in FIGS. 10-12, the outer switching cover plate 40 includes a plate body 401, and a pivot 402 and a catching jaw 403 disposed on the plate body 401. The side encasing plate 102 is formed with a snapping groove 1025, which is opened upwards. The pivot 402 is rotatably fitted within the snapping groove 1025, so that the outer switching cover plate 40 may be rotatably mounted on the side encasing plate 102.

A first free end 10232 of two free ends of the side encasing plate 102 is formed with a snapping groove 1025 therein, and a second free end 10242 of the two free ends of the side encasing plate 102 is formed with a snapping groove 1025 therein. There are two pivots 402 disposed on the plate body 401, one of the pivots 402 is rotatably fitted within the snapping groove 1025 in the first free end 10232, and the other one of the pivots 402 is rotatably fitted within the snapping groove 1025 in the second free end 10242.

As shown in FIGS. 1, 4-6, 8-10, the housing 20 is formed with a cover plate position-restricting hole 204 therein. The catching jaw 403 is engaged within the cover plate position-restricting hole 204 in the first position. Thus, the outer switching cover plate 40 may be stably maintained in the first position, in order to prevent the outer air outlet 105 from being closed when the outer air outlet 105 is used to discharge air outdoors.

The cover plate position-restricting hole 204 may be a through hole, i.e. the cover plate position-restricting hole 204 may penetrate through the top wall plate 205 of the housing 20 in an up-down direction. There may be a plurality of the catching jaws 403 and a plurality of the cover plate position-restricting holes 204. A plurality of catching jaws 403 may be engaged within a plurality of the cover plate position-restricting holes 204 in one-to-one correspondence in the first position. Thus, the outer switching cover plate 40 may be held stably in the first position.

The outer switching cover plate 40 may be a flat plate or a curved plate. The outer switching cover plate 40 is disposed obliquely in the second position so that the outer switching cover plate 40 may form a drainage slope. That is, in the second position, a surface of the outer switching cover plate 40 facing an air stream discharged from the outer air outlet 105 may form a drainage surface 404.

As described above, in the second position, the angle between the outer switching cover plate 40 and an exit direction of the second outer air vent 202 is greater than 0 degree and less than 90 degrees, more preferably, equal to or greater than 30 degrees and less than 60 degrees, i.e., the angle between the outer switching cover plate 40 and the bottom plate 101 is equal to or greater than 120 degrees and equal to or less than 150 degrees. Thus, it is possible to further reduce the flow loss of the air stream, improve the efficiency of the fan wheel, and further reduce the vortex region in order to further reduce aerodynamic noise.

In the above embodiments, the outer switching cover plate 40 may be pivotably disposed on the side encasing plate 102, and the outer air outlet 105 is opened backwards and upwards. Thus, in the first position, the outer switching cover plate 40 opens a rear opening of the outer air outlet 105 and the first outer air vent 201 (i.e. the rear opening of the outer air outlet 105 is communicated with the first outer air vent 201), while the outer switching cover plate 40 closes an upper opening of the outer air outlet 105 and the second outer air vent 202 (i.e. the upper opening of the outer air outlet 105 is separated from the second outer air vent 202). In the second position, the outer switching cover plate 40 closes the rear opening of the outer air outlet 105 and the first outer air vent 201 (i.e. the rear opening of the outer air outlet 105 is separated from the first outer air vent 201), while the outer switching cover plate 40 opens the upper opening of the outer air outlet 105 and the second outer air vent 202 (i.e. the upper opening of the outer air outlet 105 is communicated with the second outer air vent 202).

The range hood 100 according to a further specific embodiment of the present disclosure will be described below with reference to FIGS. 13-25. As shown in FIGS. 13-25, the range hood 100 includes a housing 20, a volute casing 1, a fan wheel 30, an outer switching cover plate 40 and an outer air vent seal-plate 41.

Figure 13:
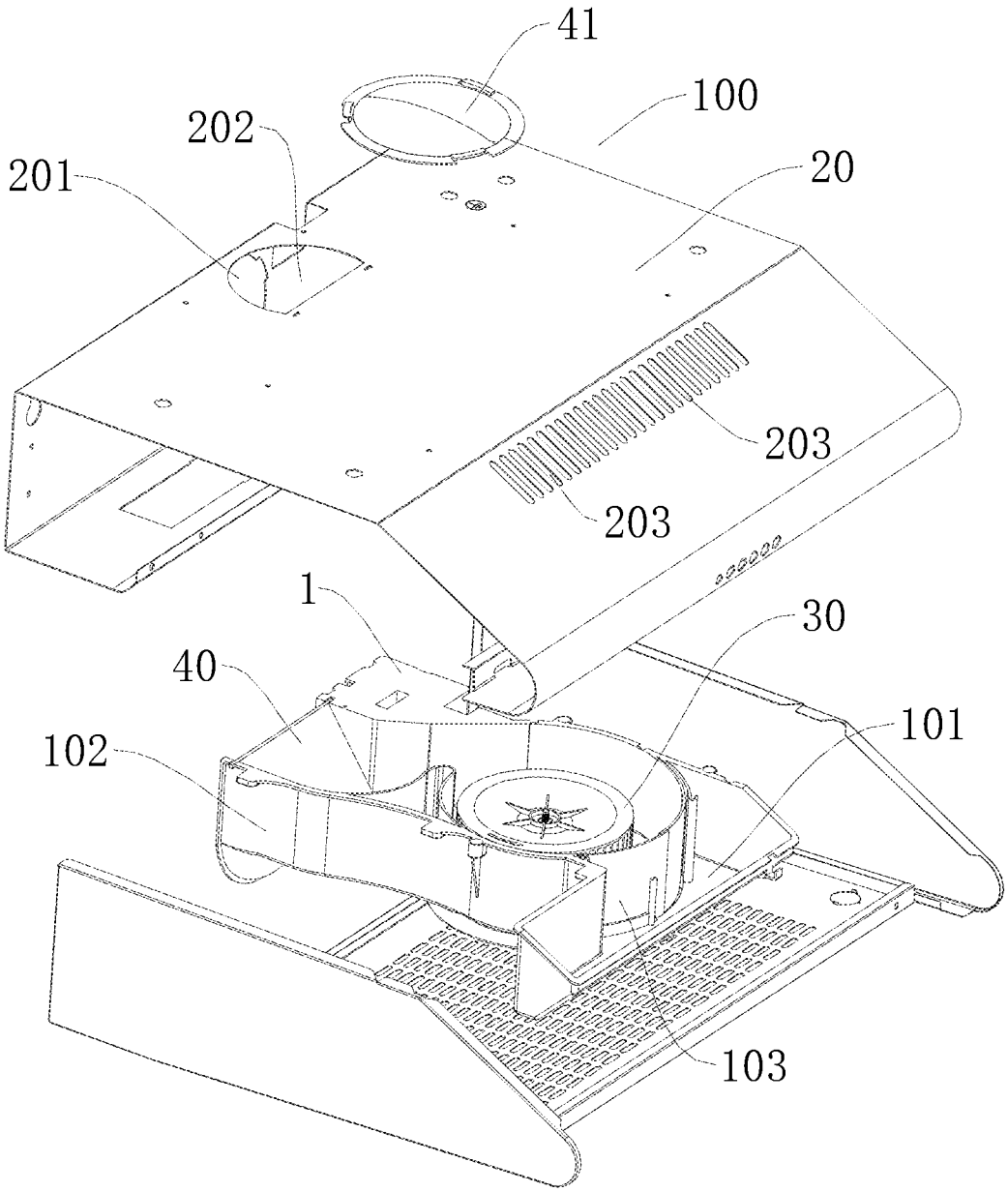
FIG. 13 is a schematic perspective view of a range hood according to another embodiment of the present disclosure.
Figure 14:
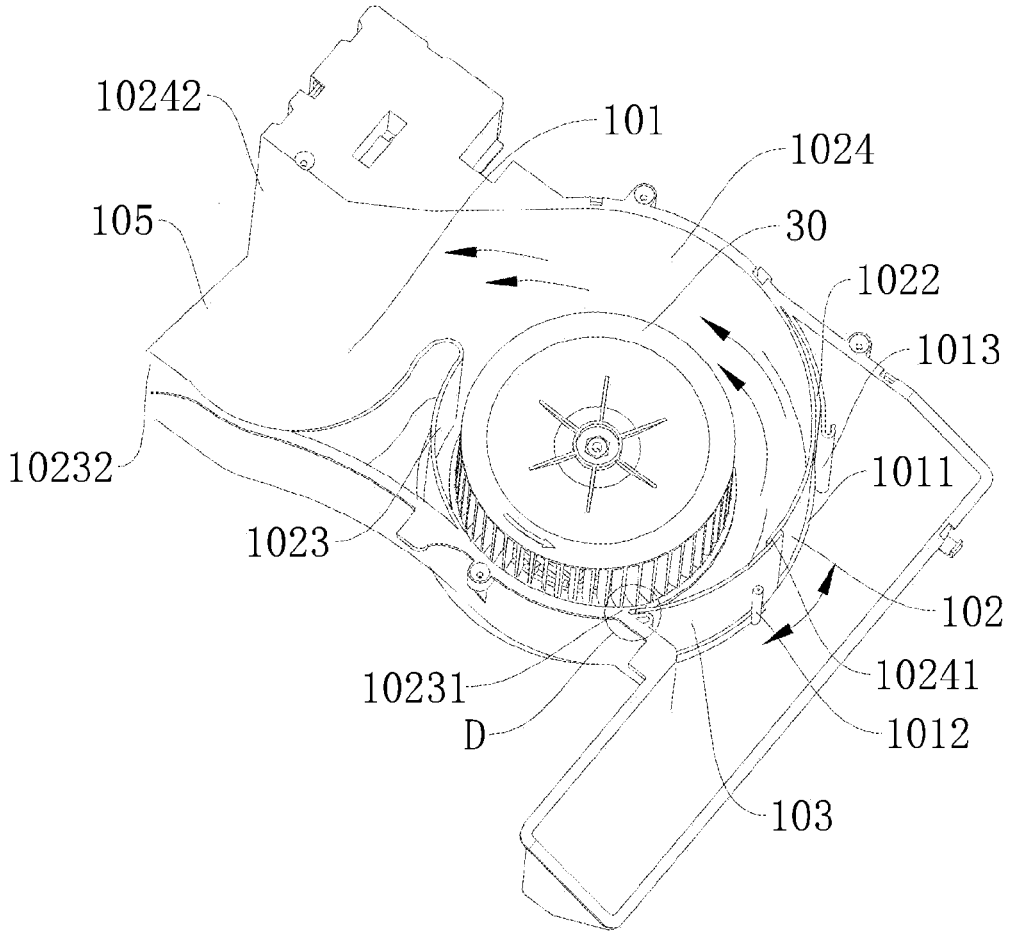
FIG. 14 is a schematic perspective view of a volute casing of the range hood shown in FIG. 13, in which the inner switching cover plate is located in a closed position.

As shown in FIG. 13, the housing 20 is formed with a first outer air vent 201, a second outer air vent 202 and an inner air vent 203 therein. As shown in FIG. 14, the volute casing 1 includes a volute casing body 10 and an inner switching cover plate 103. The volute casing body 10 includes a bottom plate 101, a top plate and a side encasing plate 102 disposed between the bottom plate 101 and the top plate. The volute casing 1 is formed with an outer air outlet 105 communicated with the first outer air vent 201 and the second outer air vent 202, and an inner air outlet 104 communicated with the inner air vent 203.

The inner switching cover plate 103 is movable between an opened position, in which the inner air outlet 104 is opened by the inner switching cover plate 103, and a closed position, in which the inner air outlet 104 is closed by the inner switching cover plate 103. In the opened position, the outer air vent seal-plate 41 seals an opened one of the first outer air vent 201 and the second outer air vent 202.

In other words, in this embodiment, the range hood 100 has three air discharging modes: an inward air discharging mode of discharging air indoors from the inner air outlet 104 and the inner air vent 203, a backward air discharging mode of discharging air outdoors from an outer air outlet 105 and the first outer air vent 201, and an upward air discharging mode of discharging air outdoors from the outer air outlet 105 and the second outer air vent 202.

For example, in the inward air discharging mode, the inner switching cover plate 103 is in the opened position. If the outer switching cover plate 40 is in the first position (i.e. the first outer air vent 201 is opened and the second outer air vent 202 is closed), the outer air vent seal-plate 41 needs to seal the first outer air vent 201. If the outer switching cover plate 40 is in the second position (i.e. the first outer air vent 201 is closed and the second outer air vent 202 is opened), the outer air vent seal-plate 41 needs to seal the second outer air vent 202.

In the backward air discharging mode, the inner switching cover plate 103 is in the closed position, and the outer switching cover plate 40 is in the first position (i.e. the first outer air vent 201 is opened and the second outer air vent 202 is closed).

In the upward air discharging mode, the inner switching cover plate 103 is in the closed position, and the outer switching cover plate 40 is in the second position (i.e. the first outer air vent 201 is closed and the second outer air vent 202 is opened).

Preferably, a shape of the inner switching cover plate 30 is configured such that in the closed position, a complete volute casing curved surface is formed by the side encasing plate 102 and a part of the inner switching cover plate 103 corresponding to the inner air outlet 104. More preferably, the inner air outlet 104 is formed in a helical curved surface of the volute casing curved surface.

That is, in the closed position, a part of the inner switching cover plate 103 for closing the inner air outlet 104 forms a complete volute casing curved surface with the side encasing plate 102. In other words, the inner air outlet 104 may be formed by cutting off a part of the side encasing plate 102, the part of the side encasing plate 102 is equivalent to the inner switching cover plate 103 or the part of the inner switching cover plate 103 corresponding to the inner air outlet 104.

According to embodiments of the present disclosure, the inner switching cover plate 103 may be used to open or close the inner air outlet 104 by providing the inner switching cover plate 103 movable between the opened position and the closed position. A complete volute casing curved surface is formed by a part of the inner switching cover plate 30 in the closed position corresponding to the inner air outlet 104 and the side encasing plate 102. Therefore, when the range hood 100 discharges air outdoors, the volute casing curved surface of the volute casing 1 may remain complete and will not be broken by the inner air outlet 104, so as to greatly reduce the flow loss of the air stream and improve the efficiency of the fan wheel of the range hood 100.

Moreover, the length of the air flue between the inner air outlet 104 and the inner air vent 203 may be reduced or there is even no need for an air flue by providing the inner switching cover plate 103 for opening or closing the inner air outlet 104. Therefore, it is possible to reduce the flow loss of the air stream and improve the efficiency of the fan wheel of the range hood 100.

As shown in FIG. 13, in one embodiment, the side encasing plate 102 includes a first side encasing plate 1023 and a second side encasing plate 1024. A first end 10231 of the first side encasing plate 1023 is spaced apart from a first end 10241 of the second side encasing plate 1024 so as to define the inner air outlet 104, and a second end 10232 of the first side encasing plate 1023 is spaced apart from a second end 10242 of the second side encasing plate 1024 so as to define the outer air outlet 105.

Specifically, a front end of the first side encasing plate 1023 is spaced apart from a front end of the second side encasing plate 1024 so as to form the inner air outlet 104, and a rear end of the first side encasing plate 1023 is spaced apart from a rear end of the second side encasing plate 1024 so as to form the outer air outlet 105. The front-rear direction is shown by an arrow J in FIG. 22.

Figure 18:
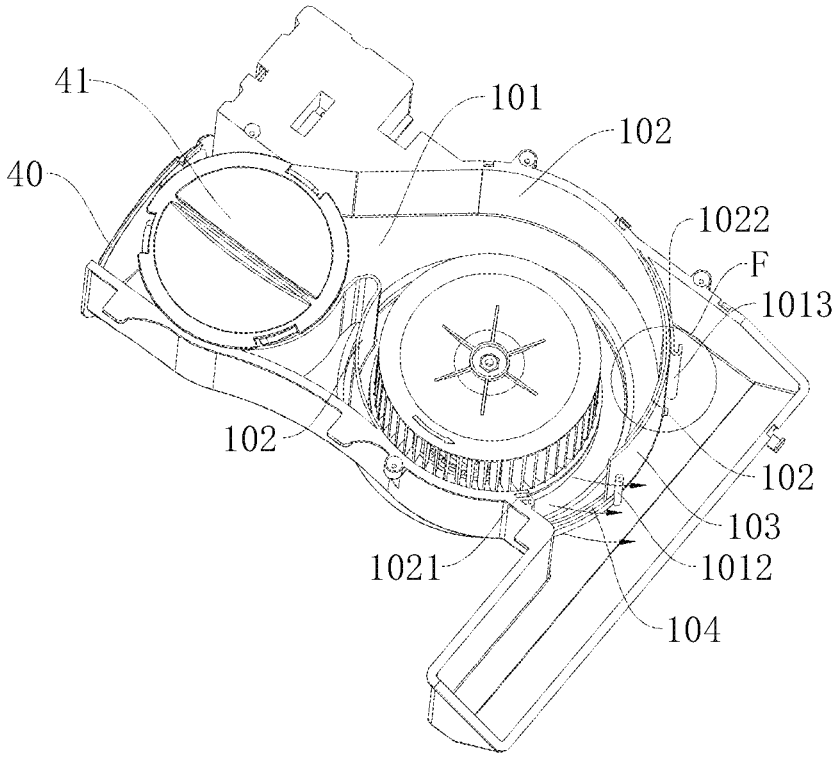
FIG. 18 is a schematic top perspective view of a volute casing of the range hood shown in FIG. 13, in which the inner switching cover plate is located in an opened position.
Figure 22:
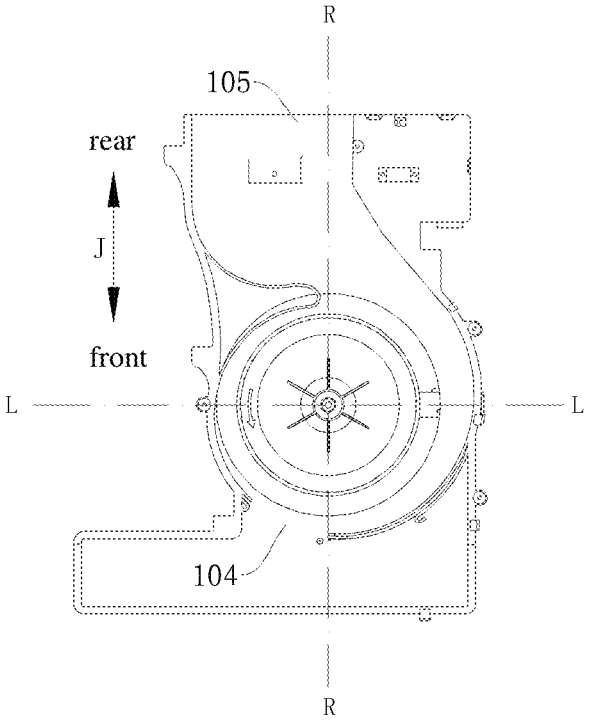
FIG. 22 is a schematic top view of a volute casing of a range hood according to an embodiment of the present disclosure.
Figure 23:
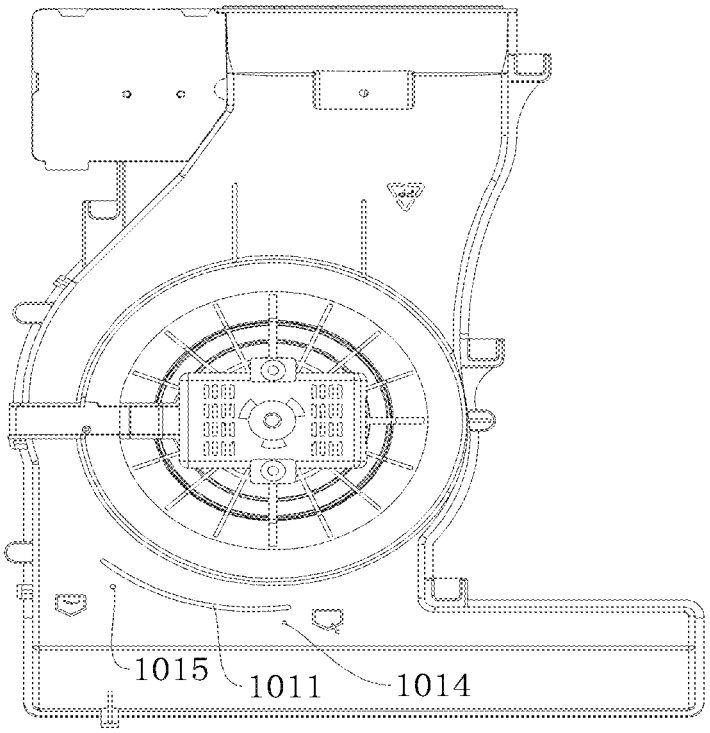
FIG. 23 is a schematic bottom view of a volute casing of a range hood according to an embodiment of the present disclosure.
Figure 24:
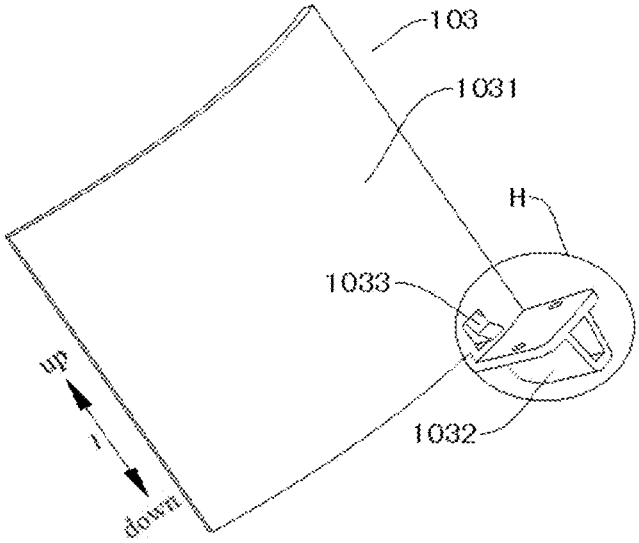
FIG. 24 is a schematic view of an inner switching cover plate of a volute casing according to an embodiment of the present disclosure.
Figure 25:
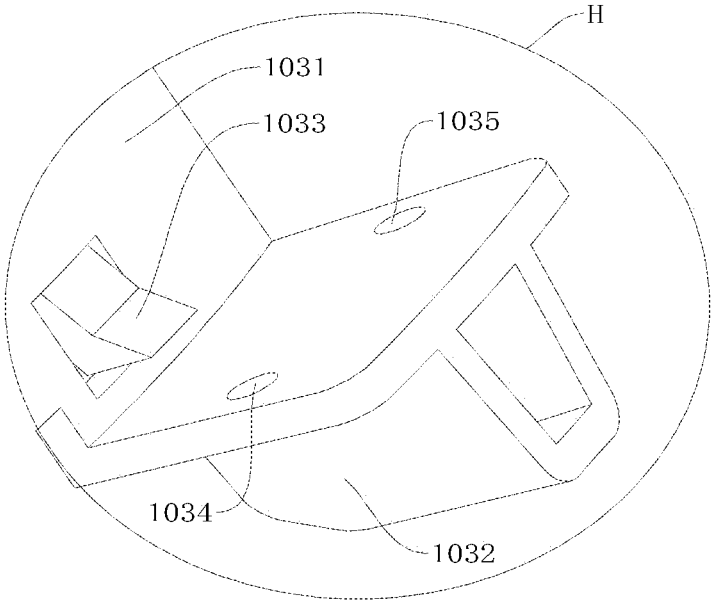
FIG. 25 is an enlarged view of H region of FIG. 24.

As shown in FIG. 18 and FIG. 22, in one specific embodiment of the present disclosure, the inner air outlet 104 is away from the outer air outlet 105 in a circumferential direction of the side encasing plate 102.

Figure 15:
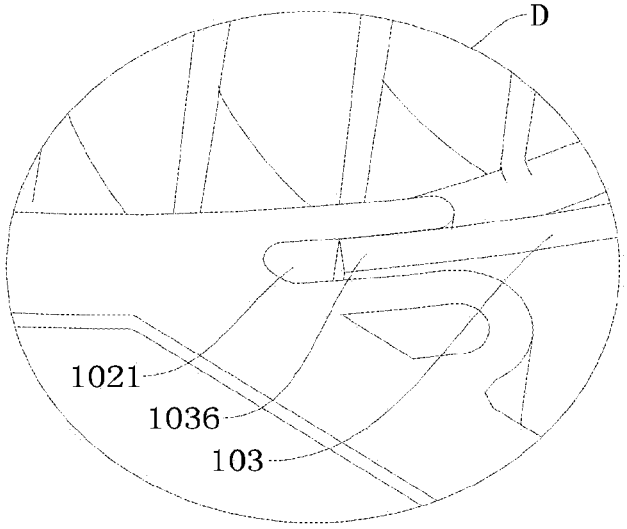
FIG. 15 is an enlarged view of D region of FIG. 14.
Figure 19:
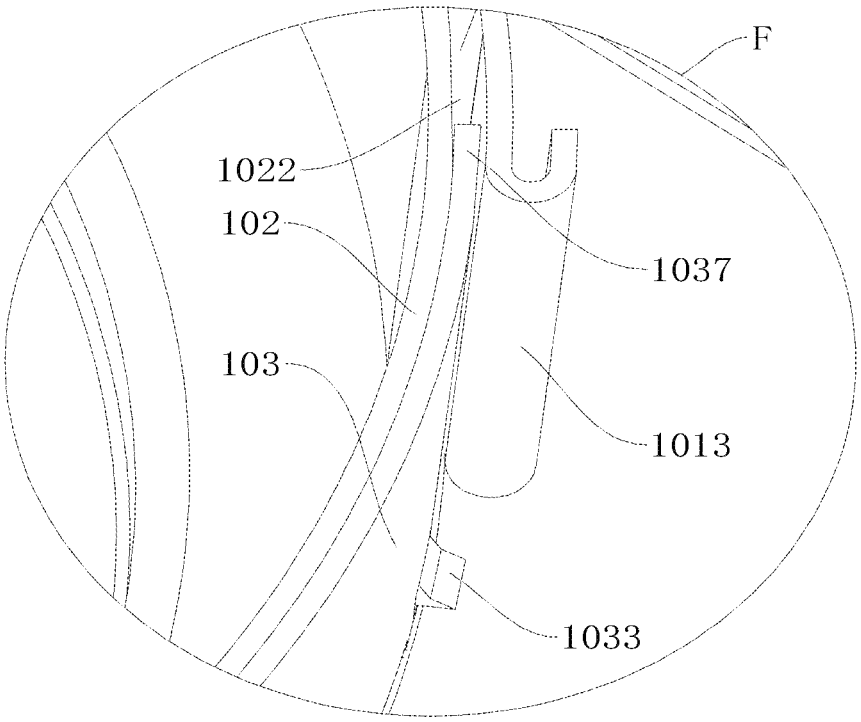
FIG. 19 is an enlarged view of F region of FIG. 18.
Figure 20:
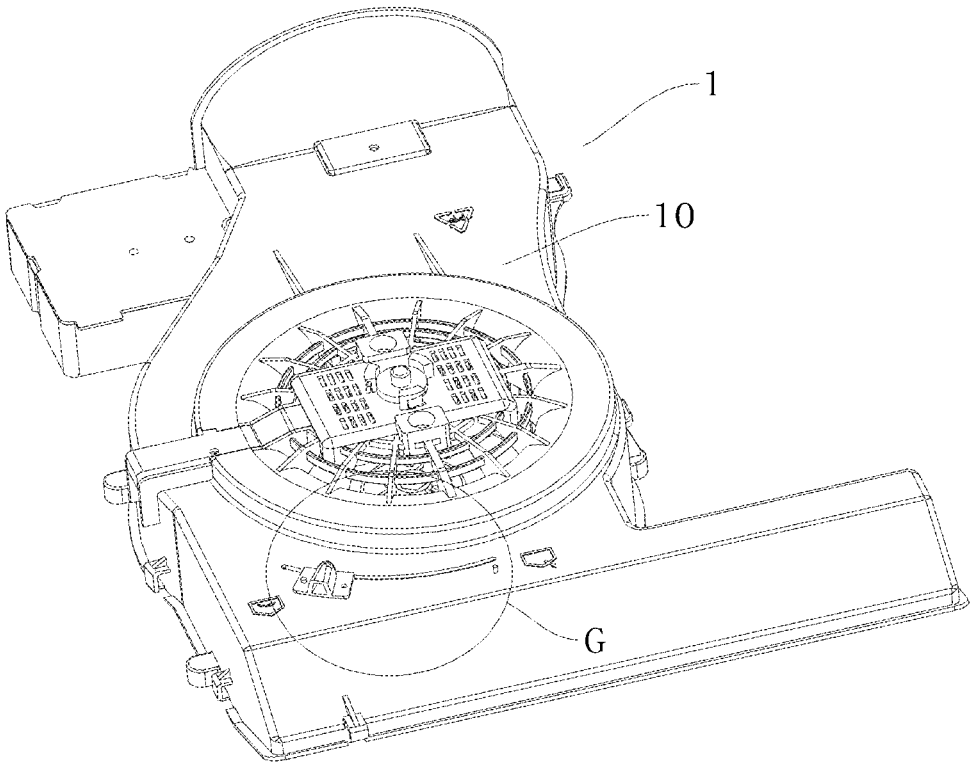
FIG. 20 is a schematic bottom view of a volute casing of the range hood shown in FIG. 13, in which the inner switching cover plate is located in an opened position.
Figure 21:
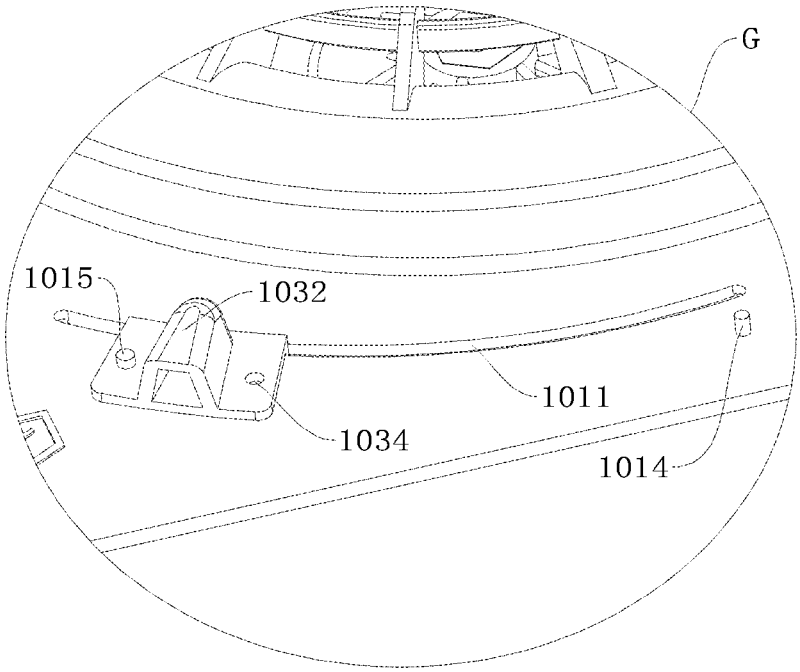
FIG. 21 is an enlarged view of G region of FIG. 20.

As shown in FIG. 15 and FIG. 19, the first end 10231 of the first side encasing plate 1023 is formed with a first position-restricting groove 1021, and the first end 10241 of the second side encasing plate 1024 is formed with a second position-restricting groove 1022. The first end 1036 of the inner switching cover plate 103 is engaged within the first position-restricting groove 1021 in the closed position, and the second end 1037 of the inner switching cover plate 103 is engaged within the second position-restricting groove 1022 in the opened position.

The first end 10231 of the first side encasing plate 1023 is formed with the first position-restricting groove 1021 therein and the first end 1036 of the inner switching cover plate 103 is engaged within the first position-restricting groove 1021 in the closed position, such that the inner air outlet 104 may be completely closed so as to prevent the air from leaking through the inner air outlet 104.

The first end 10241 of the second side encasing plate 1024 is formed with the second position-restricting groove 1022 therein and the second end 1037 of the inner switching cover plate 103 is engaged within the second position-restricting groove 1022 in the opened position, such that the inner switching cover plate 103 may remain in the opened position stably. Thus, the inner air outlet 104 may be prevented from being closed when air is discharged indoors.

Advantageously, as shown in FIG. 14 and FIG. 18, the shape of the inner switching cover plate 103 is adapted to the shape of a part of the side encasing plate 102. The inner switching cover plate 103 is attached to the side encasing plate 102 when moving in the circumferential direction of the side encasing plate 102.

Figure 16:
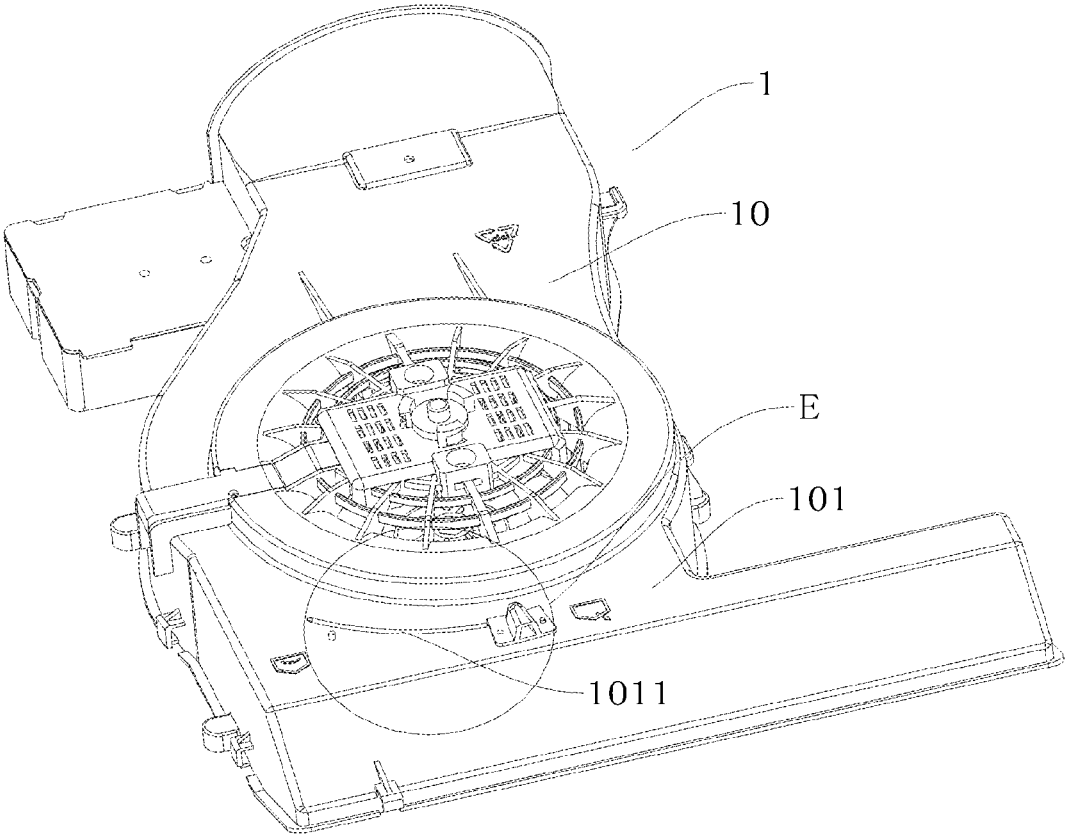
FIG. 16 is a bottom view of a volute casing of the range hood shown in FIG. 13, in which the inner switching cover plate is located in a closed position.
Figure 17:
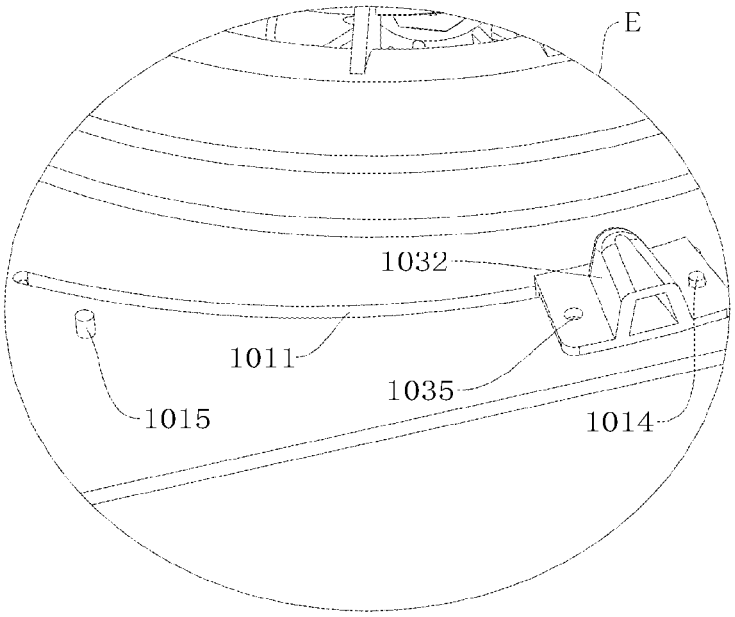
FIG. 17 is an enlarged view of E region of FIG. 16.

As shown in FIGS. 16-18, the bottom plate 101 is formed with a chute 1011 therein. The inner switching cover plate 103 is slidably fitted within the chute 1011, so that the inner switching cover plate 103 is disposed on the bottom plate 101 and movable between the opened position in which the inner air outlet 104 is opened and the closed position in which the inner air outlet 104 is closed.

In some embodiments, the chute 1011 may penetrate through the bottom plate 101 in a thickness direction of the bottom plate 101. The inner switching cover plate 103 is provided with a snapping projection 1033 on the bottom plate 101 and an operation portion 1032 below the bottom plate 101 for moving the inner switching cover plate 103 along the chute 1011. In other words, the bottom plate 101 may be clamped between the snapping projection 1033 and the operation portion 1032, and a user may drive the inner switching cover plate 103 to move by holding the operation portion 1032.

As shown in FIGS. 16-17, and 20-21, the bottom plate 101 is provided with a first position-restricting boss 1014 and a second position-restricting boss 1015 thereon, the operation portion 1032 is formed with a first position-restricting hole 1034 and a second position-restricting hole 1035 therein, the first position-restricting boss 1014 is engaged within the first position-restricting hole 1034 in the closed position, and the second position-restricting boss 1015 is engaged within the second position-restricting hole 1035 in the opened position. Therefore, the inner switching cover plate 103 may remain in the closed position or the opened position stably, such that the inner air outlet 104 may be prevented from being opened when air is discharged outdoors and prevented from being closed when air is discharged indoors.

Specifically, both of the first position-restricting boss 1014 and the second position-restricting boss 1015 are disposed on the lower surface of the bottom plate 101, the first position-restricting hole 1034 and the second position-restricting hole 1035 both penetrate through the operation portion 1032 in the up-down direction. The up-down direction is shown by an arrow I in FIG. 2 and FIG. 23.

As shown in FIGS. 18-19, in one embodiment of the present disclosure, the bottom plate 101 is provided with a first position-restricting column 1012 and a second position-restricting column 1013 thereon, which may limit the first switching cover plate 103 to move between the side encasing plate 102 and the first and second position-restricting columns 1012, 1013. Therefore, the first switching cover plate 103 may be prevented from swinging in a direction away from the side encasing plate 102 to perform a guiding function when the inner air outlet 104 is opened or closed.

Specifically, as shown in FIG. 19, the front wall of the second position-restricting groove 1022 is rolled up in a direction away from the second position-restricting groove 1022 so as to form the second position-restricting column 1013.

In the specification, it is to be understood that terms such as "central," "longitudinal," "lateral," "length," "width," "thickness," "upper," "lower," "front," "rear," "left," "right," "vertical," "horizontal," "top," "bottom," "inner," "outer," "clockwise," "counterclockwise," "axial," "radial," and "circumference" should be construed to refer to the orientation as then described or as shown in the drawings under discussion. These relative terms are for convenience of description and do not require that the present disclosure be constructed or operated in a particular orientation.

In addition, terms such as "first" and "second" are used herein for purposes of description and are not intended to indicate or imply relative importance or significance or to imply the number of indicated technical features. Thus, the feature defined with "first" and "second" may include one or more of this feature. In the description of the present disclosure, "a plurality of" means at least two, e.g. two, three and so on, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which may be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art may combine and composite different embodiments or examples and features of various embodiments or examples embodiment described in the description with no conflicting situation.

Although explanatory embodiments have been shown and described, it would be appreciated by those skilled in the art that the above embodiments are exemplary and cannot be construed to limit the present disclosure, and changes, alternatives, and modifications may be made in the embodiments within the scope of the present disclosure.

What is claimed is:

1. A range hood, comprising:

a housing defining a first outer air vent and a second outer air vent;

a volute casing disposed within the housing, and comprising a volute casing body having a bottom plate, a top plate and a side encasing plate disposed between the bottom plate and the top plate, the volute casing body defining an outer air outlet communicated with the first outer air vent and the second outer air vent, and an opening direction of the outer air outlet being orthogonal to that of the second outer air vent;

a fan wheel disposed within the volute casing body;

an outer switching cover plate disposed on one of the volute casing and the housing and movable between a first position, in which the first outer air vent is opened by the outer switching cover plate and the second outer air vent is closed by the outer switching cover plate, and a second position, in which the first outer air vent is closed by the outer switching cover plate and the second outer air vent is opened by the outer switching cover plate, an angle $\alpha$ between the outer switching cover plate in the second position and the opening direction of the second outer air vent being greater than 0 degree and less than 90 degrees; and an outer air vent seal-plate, wherein the housing defines an inner air vent, the volute casing body defines an inner air outlet communicated with the inner air vent, the volute casing further comprises an inner switching cover plate movable between an opened position, in which the inner air outlet is opened by the inner switching cover plate, and a closed position, in which the inner air outlet is closed by the inner switching cover plate, wherein the outer air vent seal-plate seals an opened one of the first outer air vent and the second outer air vent in the opened position.

2. The range hood according to claim 1, wherein an opening direction of the first outer air vent is orthogonal to the opening direction of the second outer air vent.

3. The range hood according to claim 1, wherein the angle $\alpha$ is equal to or greater than 30 degrees and equal to or less than 60 degrees.

4. The range hood according to claim 1, wherein the outer switching cover plate is disposed on the side encasing plate and pivotable between the first position and the second position.

5. The range hood according to claim 4, wherein a snapping groove is formed in the side encasing plate, and the outer switching cover plate comprises a plate body and a pivot which is disposed on the plate body and rotatably fitted within the snapping groove.

6. The range hood according to claim 1, wherein the first outer air vent is formed in a rear wall plate of the housing, and the second outer air vent is formed in a top wall plate of the housing.

7. The range hood according to claim 1, wherein the outer switching cover plate is a flat plate or a curved plate.

8. The range hood according to claim 1, wherein the housing defines a cover plate position-restricting hole, the outer switching cover plate comprises a plate body and a catching jaw which is disposed on the plate body and engaged within the cover plate position-restricting hole in the first position.

9. The range hood according to claim 1, wherein a shape of the inner switching cover plate is configured such that a complete volute casing curved surface is formed by the side encasing plate and a part of the inner switching cover plate in the closed position corresponding to the inner air outlet.

10. The range hood according to claim 9, wherein the inner air outlet is formed in a helical curved surface of the volute casing curved surface.

11. The range hood according to claim 9, wherein the inner switching cover plate clings to the side encasing plate closely during moving between the opened position and the closed position.

12. The range hood according to claim 11, wherein the bottom plate defines a chute penetrating therethrough in a thickness direction thereof, the inner switching cover plate is slidably fitted within the chute, wherein the inner switching cover plate is provided with a snapping projection on the bottom plate and an operation portion which is below the bottom plate for moving the inner switching cover plate along the chute.

13. The range hood according to claim 12, wherein the bottom plate is provided with a first position-restricting column and a second position-restricting column thereon, the snapping projection is abutted against the first position-restricting column in the closed position, and the snapping projection is abutted against the second position-restricting column in the opened position.

14. The range hood according to claim 12, wherein the bottom plate is provided with a first position-restricting boss and a second position-restricting boss thereon, the operation portion defines a first position-restricting hole and a second position-restricting hole therein, wherein the first position-restricting boss is engaged within the first position-restricting hole in the closed position, and the second position-restricting boss is engaged within the second position-restricting hole in the opened position.

15. The range hood according to claim 1, wherein the side encasing plate comprises a first side encasing plate and a second side encasing plate, wherein a first end of the first side encasing plate is spaced apart from a first end of the second side encasing plate such that the inner air outlet is defined by the first end of the first side encasing plate, the first end of the second side encasing plate, the top plate and the bottom plate, wherein a second end of the first side encasing plate is spaced apart from a second end of the second side encasing plate such that the outer air outlet is defined by the second end of the first side encasing plate, the second end of the second side encasing plate, the top plate and the bottom plate.

16. The range hood according to claim 15, wherein a first position-restricting groove is formed in the first end of the first side encasing plate, a second position-restricting groove is formed in the first end of the second side encasing plate, the first end of the inner switching cover plate is engaged within the first position-restricting groove in the closed position, and a second end of the inner switching cover plate is engaged within the second position-restricting groove in the opened position.

17. A volute casing, comprising:

a volute casing body comprising a bottom plate, a top plate and a side encasing plate disposed between the bottom plate and the top plate, the volute casing body defining a first outer air outlet and a second outer air outlet, and an opening direction of the first outer air outlet being orthogonal to that of the second outer air outlet;

an outer switching cover plate disposed on the volute casing body and movable between a first position, in which the first outer air outlet is opened by the outer switching cover plate and the second outer air outlet is closed by the outer switching cover plate, and a second position, in which the first outer air outlet is closed by the outer switching cover plate and the second outer air outlet is opened by the outer switching cover plate, an angle $\alpha$ between the outer switching cover plate in the second position and the opening direction of the second outer air outlet being greater than 0 degree and less than 90 degrees; and an outer air vent seal-plate, wherein the housing defines an inner air vent, the volute casing body defines an inner air outlet communicated with the inner air vent, the volute casing further comprises an inner switching cover plate movable between an opened position, in which the inner air outlet is opened by the inner switching cover plate, and a closed position, in which the inner air outlet is closed by the inner switching cover plate, wherein the outer air vent seal-plate seals an opened one of the first outer air vent and the second outer air vent in the opened position.

18. The volute casing according to claim 17, wherein the angle $\alpha$ is equal to or greater than 30 degrees and equal to or less than 60 degrees.

* * * * *